US005450740A

United States Patent [19]

Lovinggood et al.

[11] Patent Number: 5,450,740

[45] Date of Patent: Sep. 19, 1995

[54] ROLL FORMING MACHINE

[75] Inventors: Steve Lovinggood, Moreno Valley, Calif.; Douglas S. Matsunaga, Mettawa, Ill.; George Schaeffer, Lindon, Utah

[73] Assignee: Braner USA, Inc., Schiller Park, Ill.

[21] Appl. No.: 201,787

[22] Filed: Feb. 25, 1994

[51] Int. Cl.[6] ..... B21B 31/10

[52] U.S. Cl. ..... 72/182; 72/181; 72/226; 72/239

[58] Field of Search ..... 72/181, 182, 176, 226, 72/239, 238

[56] References Cited

U.S. PATENT DOCUMENTS

| | | | |
|---|---|---|---|
| 1,712,575 | 5/1929 | McArthur | 72/239 |
| 1,833,376 | 11/1931 | Simmons | 72/226 |
| 3,251,210 | 5/1966 | Werntz | 72/181 |
| 3,796,081 | 3/1974 | Boardman | 72/226 |
| 4,142,393 | 3/1979 | Nagel | 72/226 |
| 4,557,129 | 12/1985 | Lash | 72/226 |
| 4,724,695 | 2/1988 | Stoehr | 72/226 |

FOREIGN PATENT DOCUMENTS

| | | | |
|---|---|---|---|
| 500989 | 3/1925 | Germany | 72/237 |
| 38719 | 2/1986 | Japan | 72/238 |

*Primary Examiner*—Daniel C. Crane
*Attorney, Agent, or Firm*—Baker & Daniels

[57] ABSTRACT

A roll forming machine which includes an outboard housing having dual turrets, each turret carries a pair of rotatable arbors which can carry forming rollers. The outboard housing is slidable along guide rails between on-line and off-line positions. In the off-line position the turrets may be indexed to bring the second pair of arbors into a working alignment and thus reduce change-over and down time of the roll forming line.

7 Claims, 5 Drawing Sheets

ROLL FORMING MACHINE

FIELD OF THE INVENTION

This invention relates to roll forming machines and will have particular application in tube mill operations.

BACKGROUND OF THE INVENTION

Roll forming is a process whereby flat strip material is converted into welded tubing A typical roll former (or tube mill) includes multiple sections where a number of machines perform the forming, welding, sizing, cooling and finishing operations. The typical tube mill operation includes a plurality of tooling stands which carry the various rolls necessary to convert a moving flat strip of material into a finished metal tube.

Previously, the tooling stands each included one or more rolls which were useful to form tubes of one predetermined size and wall thickness. When the stands need to be changed in order to form tubes of different sizes or wall thickness, each entire stand must be lifted by crane and removed before the new stands can be set up. The changeover operation is very time consuming, and a single tube mill line may often require a full day during which no production can occur. As a result, tube mills are forced to run large quantities of material and will often overstock on a single size or thickness of pipe due to the high cost of a line changeover.

Quick disconnect couplers and removable/interchangeable mill stands have sped up the process of changeover, as have interchangeable sections which include multiple mill stands. However, such mill stands are expensive and still difficult and time consuming to change, particularly because of the cramped relationship between adjacent mill stands.

A similar problem previously existed in metal slitting operations. U.S. Pat. No. 3,727,503 discloses a metal slitter which revolutionized the slitting industry by providing multiple arbors on a single slitting machine. This allowed the machine operators to work on the idle arbor at the same time that the working arbor was in operation. When a changeover was required, the slitter head was pivoted to swing the second arbor into a working position. As a result, down time was significantly reduced during changeover operations.

SUMMARY OF THE INVENTION

The roll forming machine of this invention includes a mill stand turret which rotatably houses a pair of arbors. The forming rolls are removably carried by the arbors. One of the pair of arbors is spaced away from the working line, which allows operators to set up that arbor for subsequent roll forming operations. When a line changeover is desired, the individual mill stands are retracted away from the working line to allow the turret to be rotated and bring the other arbor into a working position.

The roll forming machine may be adapted for use in any of the sections of a tube line which require a changeover when the size or thickness of the desired end product is to be changed. This includes, without limitation, the forming, cluster, finishing, welding, sizing, cutting and squaring stations of the tube mill line. The machine greatly reduces changeover times and allows the operators to work on setting up the idle arbors during a production run to further reduce down time.

Accordingly, it is an object of this invention to provide for a novel and improved roll forming machine.

Another object of this invention is to provide for a roll forming machine which can be adapted for use in a tube milling production line and which reduces down time during changeover operations.

Another object is to provide for a roll forming machine which allows on site set up work to be performed on the idle machine arbor during a production run which utilizes the other machine arbor.

Another object is to provide for a roll forming machine which can be quickly shifted off the line and pivoted to bring the second arbor into a work position without the use of a heavy lift crane.

Another object is to provide a roll forming machine which can be adapted for use in nearly all sections of a tube mill production line.

Another object is to provide for a roll forming machine which can be retrofitted into the drive systems of current tube mill stations.

Other objects will become readily apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to best enable others skilled in the art to follow its teachings.

Figure 4:
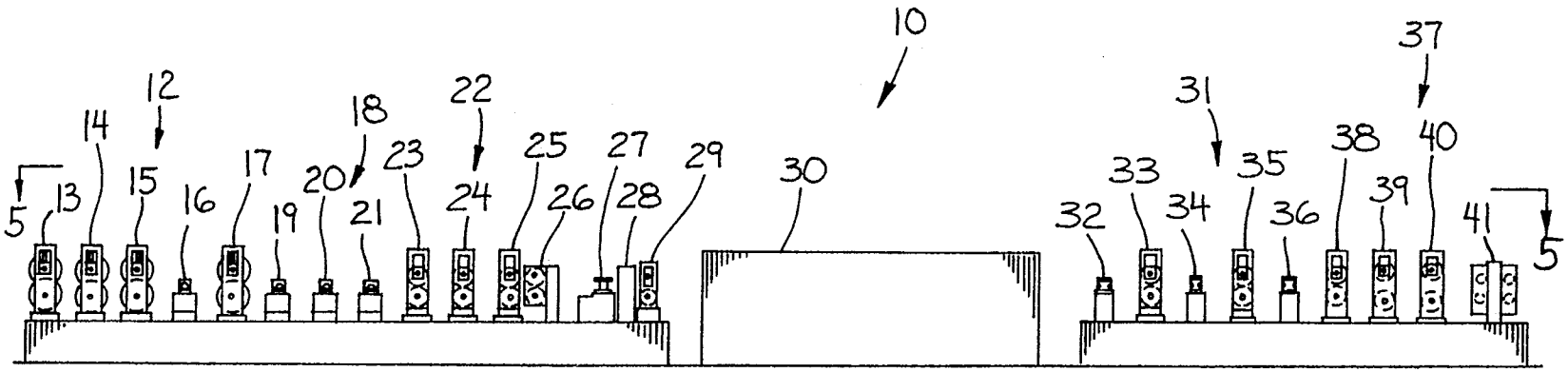
FIG. 4 is an elevation view of a roll forming line.
Figure 5:
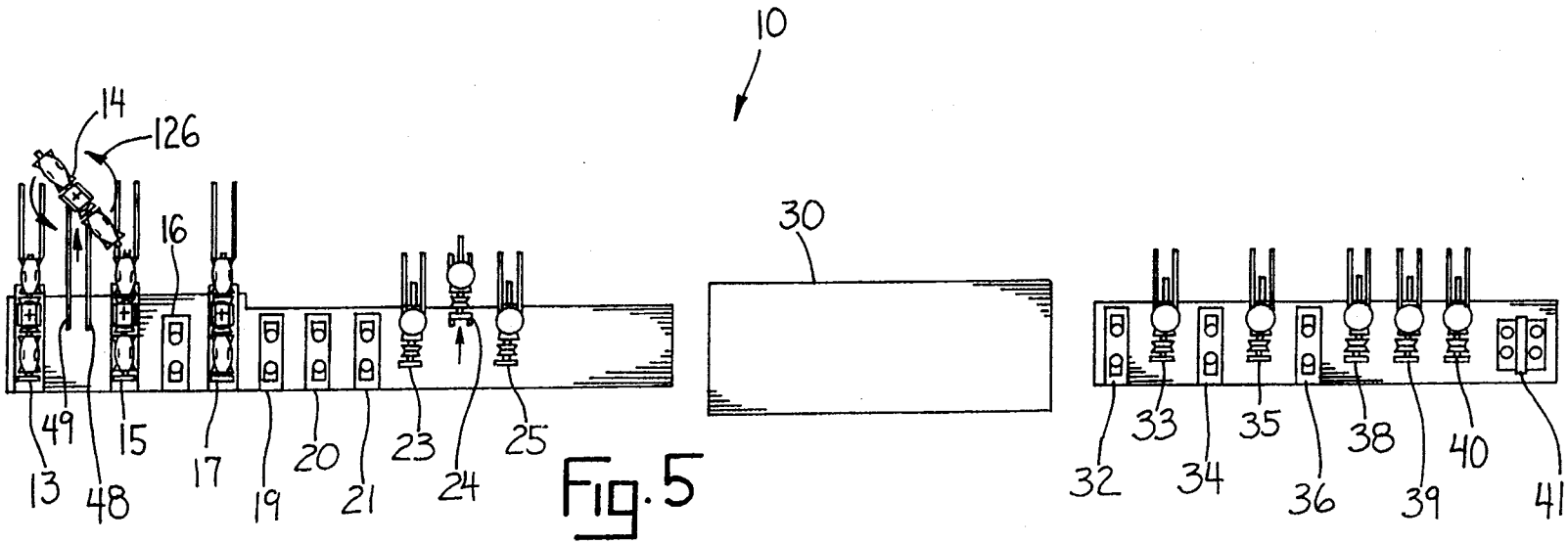
FIG. 5 is a top plan view of a roll forming line which incorporates the roll forming machines of this invention.

Referring first to the drawings of FIGS. 4 and 5, reference numeral 10 generally designates a roll forming line, commonly used in making cylindrical tubes from sheet metal products. As shown in FIG. 4, a typical line 10 includes numerous machines which form the various sections of the line. These include forming section 12, which includes mill stands 13, 14, 15, 16 and 17; a cluster section 18 which includes mill stands 19, 20 and 21; a finishing section 22 which includes mill stands 23, 24, 25 and 26; a welding section which includes mill stands 27, 28 ad 29; a cooling section 30; a sizing section 31 which includes mill stands 32, 33, 34, 35 and 36; and a squaring section 37 which includes mill stands 38, 39, 40 and 41. Sheet steel enters the line 10 from an uncoiler (not shown) at forming section 12 and exists line 10 after passing through squaring section 37. Line 10 roll gradually forms flat sheet steel into cylindrical tubes, which are cut to specified lengths after exiting the squaring section 37.

The general process by which cylindrical tubing is formed from flat sheet steel is well-known and will not be described in detail in the interests of clarity. Generally, it is preferable if at least mill stands 13, 14, 15, 17, 23, 24, 25, 33, 35, 38, 39 and 40 are constructed according to the principles of this invention. Since the construction of these mill stands is generally the same, a detailed description will be provided only for mill stand 13 with the understanding that this general construction will apply to all affected mill stands which utilize the principles of this invention.

Figure 1:
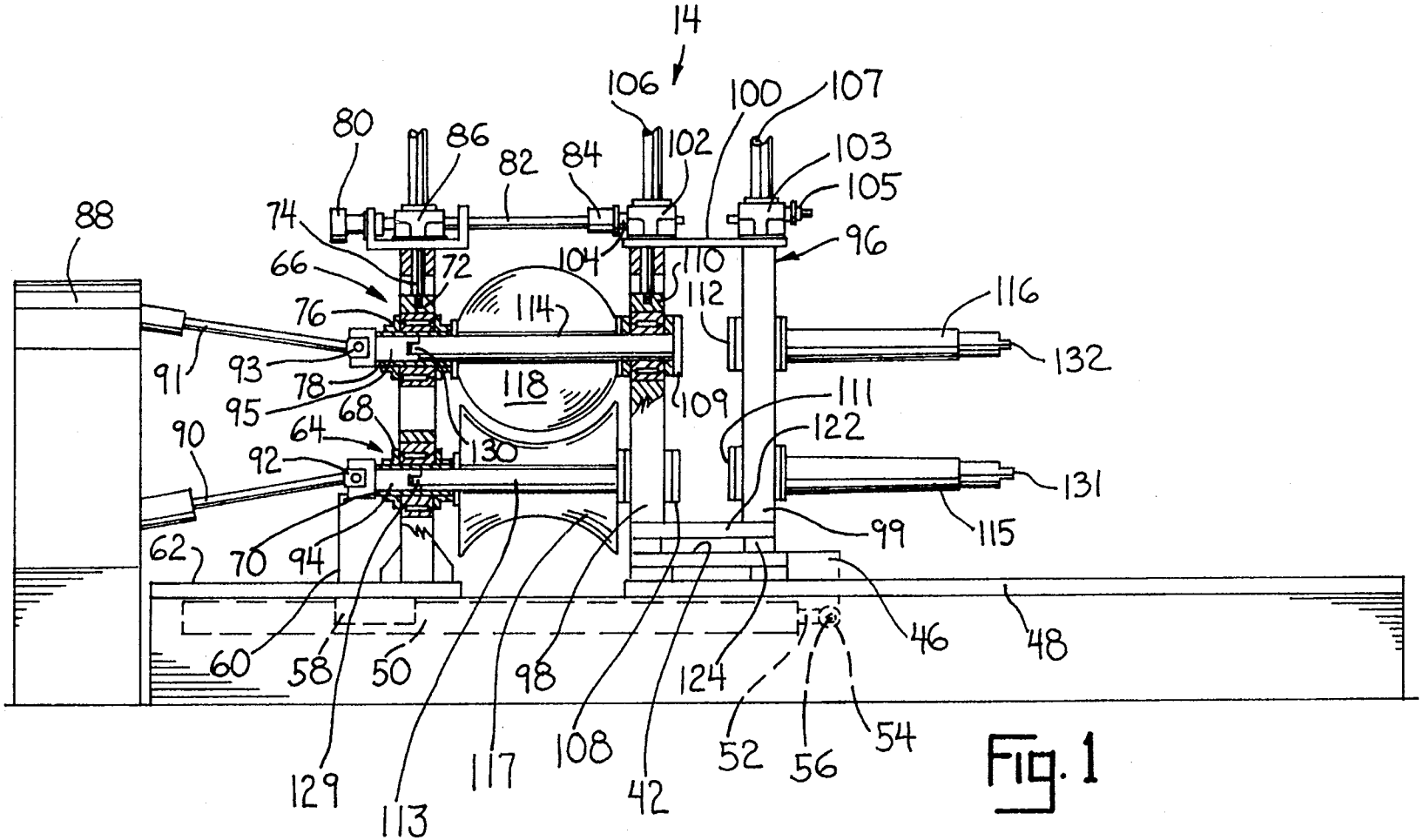
FIG. 1 is an elevation view of the roll forming machine of this invention, with portions shown in section to illustrate the arbor connections.

Mill stand 14 is shown in elevation in FIG. 1, and illustrates the working position of the mill stand. Mill stand 14 includes main support frame 42 which includes spaced rail coupling brackets 46 (one shown) located on both sides of the support frame 42. Frame 42 is supported above slide rails 48, 49 by brackets 46 which slidably connect the frame to the rails for relative sliding movement between the work position of FIG. 1 and the retracted standby and changeover positions of FIGS. 2 and 3.

Power driven cylinder 50, typically a hydraulic cylinder having an extensible push rod 52 is fixedly secured to rails 48, 49 or to bracket 58 of inboard housing 60 as shown. A lower connecting bracket 54 of frame 42 is connected to the terminal end of push rod 52 as by bolt 56 to allow for linear translation of movement between the push rod and bracket 54.

Upright inboard housing 60 is fixed to support table 62 by conventional means. Inboard housing 60 carries spaced bearing blocks 64, 66. Lower bearing block 64 is fixedly connected to housing 60 and includes collar 68 and sleeve 70. Upper bearing block 66 is adjustably connected to housing 60 as by block 72 and jackscrew 74 and also has a collar 76 and sleeve 78. Motor 80 is supported atop bearing block 60 and includes rotatable drive shaft 82 which terminates in coupler 84. Drive shaft 82 extends through gear box 86 which is mechanically connected to jackscrew 74 so as to translate rotational movement of the drive shaft into rotational movement of the jackscrew, and corresponding linear movement of bearing block 66.

Main drive motor (not shown) is housed in cabinet 88. Drive shafts 90 and 91 extend from cabinet 88 and are connected via universal joints 92 and 93 respectively and keyed couplings 94 and 95 to bearing blocks 66 and 64. Keyed couplings 94 and 95 extend into a respective sleeve 78, 70 of bearing blocks 66, 64 respectively.

Frame 42 supports outboard housing 96 which includes spaced upright turrets 98 and 99. Plate 100 serves to connect turrets 98 and 99 and supports gear boxes 102 and 103. Couplings 104 and 105, respectively are connected to and extend from gear boxes 102, 103. Jackscrews 106 and 107 extend through and are mechanically connected to gear boxes 102, 103 for translational movement.

Outboard housing turret 98 carries and supports bear blocks 108, 109. Bearing block 108 is fixedly connected to turret housing 98 and is generally aligned with bearing block 64. Bearing block 109 is vertically adjustable and is connected to turret 98 as by block 110 connected to jackscrew 106. Turret 99 supports bearing blocks 111 and 112 in a similar fashion.

A first pair of rotatable arbors 113 and 114 is carried in bearing blocks 108 and 109. A second pair of arbors 115 and 116 is rotatably housed in bearing blocks 111 and 112. Forming rollers 117 and 118 are carried by and supported on arbors 113 and 114 respectively. The configuration and size of rollers 117, 118 will depend upon the predetermined size and desired diameter of pipe to be formed, and by the position of the particular mill stand 13 in line 10. Since sheet steel is gradually bent to form cylindrical pipe, the rollers 117, 118 will vary slightly in configuration as the line 10 progresses. The basic process of forming cylindrical pipe from sheet steel is well known and does not form part of this invention. Collars 120 serve to secure rollers 117, 118 to arbors 113, 114 to prevent relative movement therebetween. In the embodiment shown, rollers 117 and 118 rotate along with arbors 113, 114 with no relative rotation taking place.

Outboard housing 96 includes a lower table 122 which is rotatably supported atop frame 42 as by bearing 124. Drive means (not shown) is connected to table 122 and serves to rotate the table about a vertical axis as depicted by arrow 126 in FIG. 3.

Arbors 115 and 116 are also adapted to carry rollers (shown in dotted line form) 127, 128. The construction of arbors 115, 116 is the same as arbors 113, 114. Each arbor 113–116 includes a key 129, 130, 131, 132 which mates with keyed coupling 94 or 95, depending upon the position of the arbor, when the outboard housing is in the work position.

Figure 2:
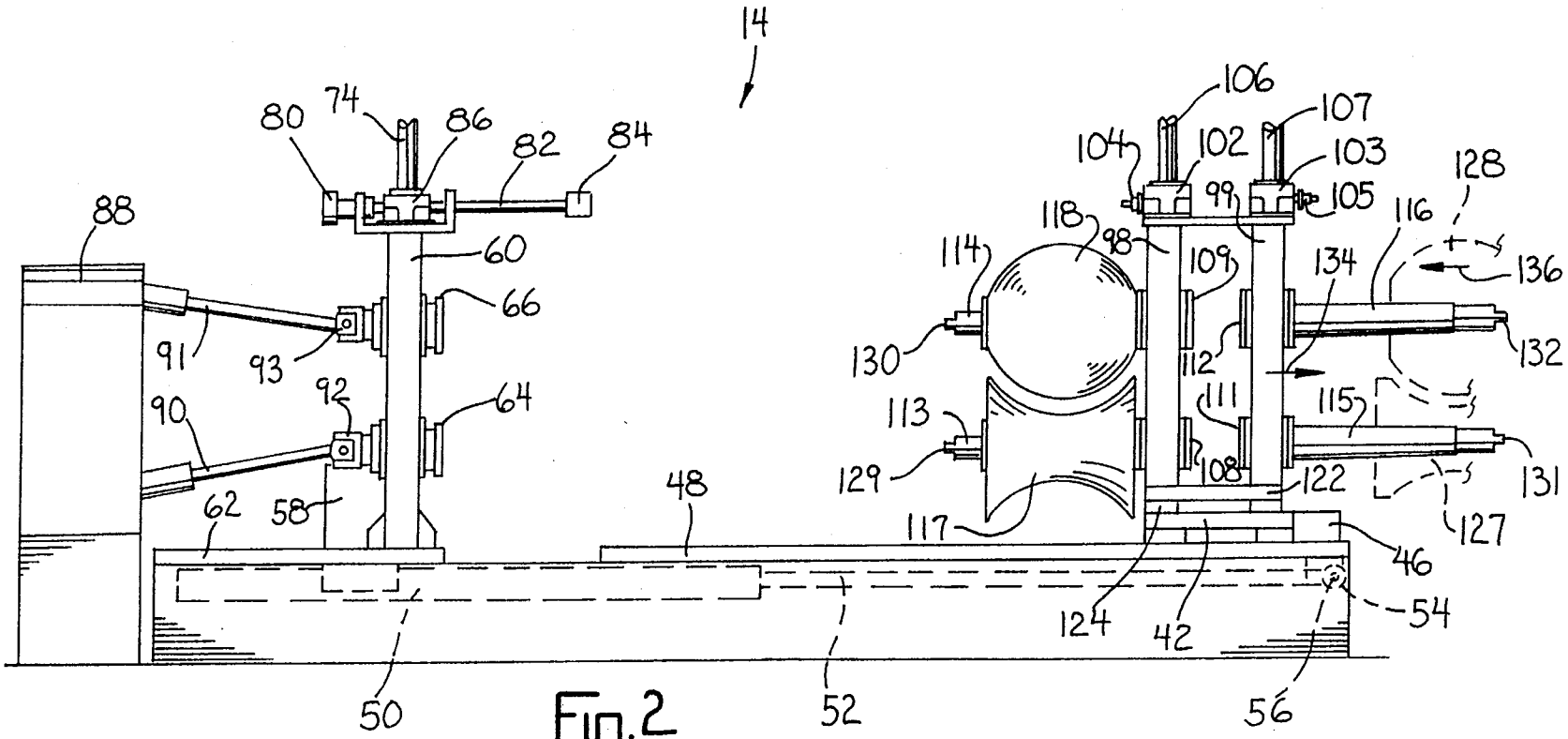
FIG. 2 is an elevation view similar to FIG. 1, showing the inboard bearing in a retracted portion preparatory to pivoting the second pair of arbors into the work position.
Figure 3:
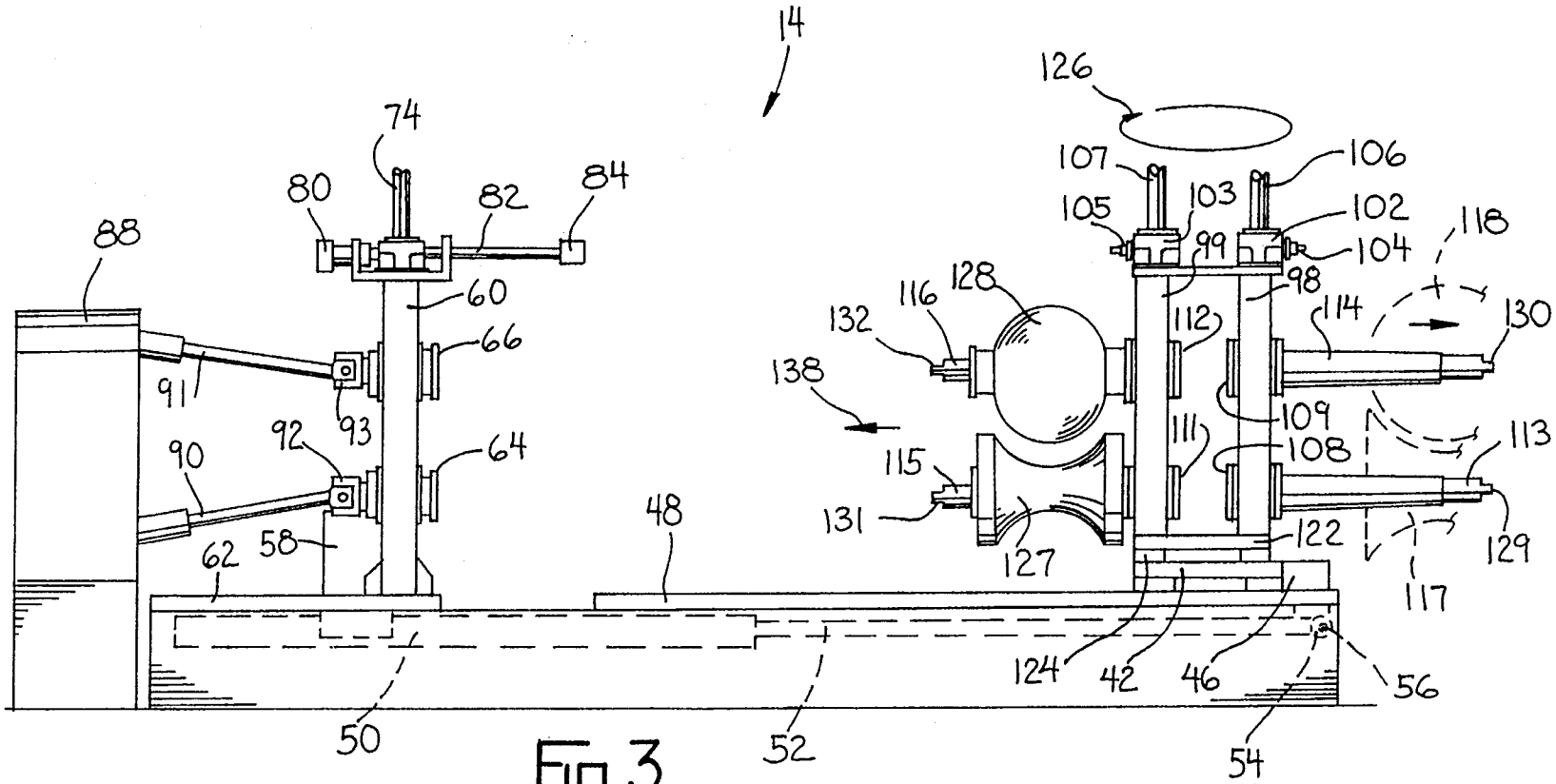
FIG. 3 is an elevation view similar to FIG. 2, showing the inboard housing after pivoting of the second arbors.

FIGS. 1–3 illustrate the functionality and operation of mill stand 14. Because of the many variations in wall thickness and pipe diameters, roll forming companies must often change the rollers used in a given line. Also, due to manufacturing considerations, each mill stand is positioned relatively close to an adjacent stand to prevent slack from developing in the steel as it passes through the line. The relatively close positioning of mill stands prevents on-line changing of rollers without physically removing the individual mill stands from the pass line.

Mill stand 14 is shown in the working or on-line position in FIG. 1. In this position, push rod 52 is fully retracted in cylinder 50, and each working arbor 113, 114 has its key 129, 130 in mating engagement with keyed couplings 94, 95 of drive shafts 90, 91. Also, screw drive shaft coupler 84 engages coupling 104 which mechanically connects jackscrews 74 and 106 to equalize vertical shifting of bearing blocks 66 and 109, if adjustment is required.

During operation, rotational movement of drive shafts 90, 91 rotates arbors 113, 114 and connected rollers 117, 118 and sheet steel is passed through the rollers to be bent. Successive mill stands in the tube line 10 further shape the steel until it emerges in sealed tube form.

When it is desired to change rollers, such as when different wall thickness or pipe diameter is to be run, mill stand 14 need not be removed from the line 10 by crane, as previously required. FIGS. 2 and 5 illustrate the step of removing mill stand 14 from line 10. Cylinder push rod 52 is extended, and by virtue of its connection to bracket 54, frame 42 slides along rails 48, 49 in the direction of arrow 134 until the full off-line position is reached as shown. Preferably, the rollers 127, 128 (shown in dotted line form in FIG. 2, and in solid lines in FIG. 3) are already secured to standby arbors 115, 116 (see arrow 136) so as to further reduce changeover time and to reduce the downtime of line 10.

Outboard housing 96 is then rotated as indicated by arrow 126 to bring the standby arbors 115, 116 and rollers 127, 128 into the working alignment shown in FIG. 3. Cylinder push rod 52 is then retracted to slide outboard housing 96 towards inboard housing 60 (arrow 138) until keys 131, 132 engage keyed couplings 94, 95 as before described. Vertical adjustments are again performed by rotation of jackscrews 74, 107. Rollers 117, 118 secured to standby arbors 113, 114 may be removed and replaced if necessary.

The above procedure is carried out for each mill stand along line 10 which requires that different rollers be used. By providing for the shiftable mill stands and rotatable turret heads, changeover and down time is significantly reduced with no loss in accuracy of roller settings.

It is understood that the above description does not limit the invention to the above-given details, but may be modified within the scope of the following claims.

What is claimed is:

1. A roll forming machine comprising a drive bearing housing, a support frame, a rotatable bearing housing connected to said frame, an active pair of spaced rotatable arbors supported between said drive bearing housing and said rotatable bearing housing, said active pair of arbors constituting means for carrying a first pair of tube shaping rolls defining a material pass line therebetween, drive means for rotating said active pair of arbors as a strip of metal passes through said rolls, turret means for rotatably connecting said rotatable bearing housing to said frame, an inactive pair of spaced rotatable arbors connected to said rotatable bearing housing, said inactive pair of arbors constituting means for carrying a second pair of tube shaping rolls with the inactive pair of arbors in a standby position as said active pair of arbors is in an operating position along said pass line connected to said drive means through said drive bearing housing and support means for supporting said frame for movement between an operative position with said active pair of arbors coupled to said drive means and a set up position with said active pair of rollers disconnected from said drive bearing housing and with both pairs of arbors displaced from said pass line along the axes of said arbors and displaced from adjacent roll forming machines to allow rotation of said turret means whereby the inactive arbors become the active arbors after displacement of the rotatable bearing housing back into the operative position.

2. The roll forming machine of claim 1 and power driven means for displacing said frame between said operative position and said set up position.

3. The roll forming machine of claim 1 wherein said support means includes a pair of parallel rails, said frame including rail couplers which slidably engage each rail.

4. The roll forming machine of claim 1 wherein each pair of arbors includes coupling means for quick connection and disconnection to said drive means.

5. The roll forming machine of claim 1 and means carried by said housing for adjusting vertical spacing between the arbors comprising said active pair of arbors and the arbor comprising said inactive pair of arbors.

6. The roll forming machine of claim 1 wherein each arbor of said active pair of arbors are oriented in a substantially straight line with a corresponding arbor of said inactive pair of arbors.

7. The roll forming machine of claim 1 wherein said rotatable bearing housing includes a pair of bearing support structures, one of said bearing support structures supporting corresponding ends of the active pair of arbors, the other bearing support structure supporting corresponding ends of the inactive pair of arbors.

* * * * *